US006779845B1

(12) United States Patent
Lin et al.

(10) Patent No.: US 6,779,845 B1
(45) Date of Patent: Aug. 24, 2004

(54) CHAIR BACKREST PROVIDED WITH A VERSATILE CUSHION

(76) Inventors: Tsung-I Lin, No. 8, Alley 36, Lane 239 Tung Jung Rd., Pei Tun District, Taichung City (TW); Chia-Hao Lu, No. 1, Lane 292, Sec. 2, Ya Tan Rd., Tan Tzu Hsiang, Taichung Hsien (TW)

( * ) Notice: Subject to any disclaimer, the term of this patent is extended or adjusted under 35 U.S.C. 154(b) by 0 days.

(21) Appl. No.: 10/394,518

(22) Filed: Mar. 24, 2003

(51) Int. Cl.[7] ..... A47C 7/36

(52) U.S. Cl. ..... 297/284.4; 297/283.3; 297/283.4; 297/391; 297/112; 297/114

(58) Field of Search ..... 297/112, 114, 297/283.3, 283.4, 284.4, 284.5, 391, DIG. 6

(56) References Cited

U.S. PATENT DOCUMENTS 1,935,685 A * 11/1933 White ..... 297/410
2,060,298 A * 11/1936 Gailey ..... 297/230.13
2,591,306 A * 4/1952 Sherman ..... 297/284.5
3,279,849 A * 10/1966 Radke et al. ..... 297/284.5
4,738,488 A * 4/1988 Camelio ..... 297/383
4,747,639 A * 5/1988 Pfau ..... 297/219.1
5,171,064 A * 12/1992 Boussaroque ..... 297/391
5,533,787 A * 7/1996 Xiang ..... 297/284.5
5,816,657 A * 10/1998 Hecht et al. ..... 297/391
6,053,569 A * 4/2000 Flyborg ..... 297/94
6,394,544 B1 * 5/2002 Bieven et al. ..... 297/283.4

* cited by examiner

*Primary Examiner*—Peter M. Cuomo
*Assistant Examiner*—Joseph Edell
(74) *Attorney, Agent, or Firm*—Harrison & Egbert

(57) ABSTRACT

A chair includes a backrest which is provided with a cushion. The cushion is an integral part of the backrest and can be used as a headrest, neckrest, or waist support.

4 Claims, 10 Drawing Sheets

CHAIR BACKREST PROVIDED WITH A VERSATILE CUSHION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a chair, and more particularly to a backrest of the chair.

BACKGROUND OF THE INVENTION

The conventional chair backrest is provided with a padded body which is removably attached to the backrest as a waist support. The padded body is in fact not an integral part of the backrest and is therefore apt to be misplaced after being removed from the backrest. In addition, the padded body is generally not well coordinated with the chair in terms of color and esthetic effect.

The backrest of certain conventional chairs are provided with a built-in cushion which can be moved and located by a transmission member of the backrest. Such a conventional backrest as described above is not cost-effective due to the high cost of the transmission member.

BRIEF SUMMARY OF THE INVENTION

The primary objective of the present invention is to provide a chair with a backrest which is furnished with a versatile cushion capable of serving as a waist support, a neckrest, or a headrest. The cushion is an integral part of the backrest.

The features and the advantages of the present invention will be more readily understood upon a thoughtful deliberation of the following detailed description of the present invention with reference to the accompanying drawings.

DETAILED DESCRIPTION OF THE INVENTION

As shown in FIGS. 1–5, a chair embodiment in the present invention comprises a base frame 11, a seat 12, and a backrest 13.

Figure 1:
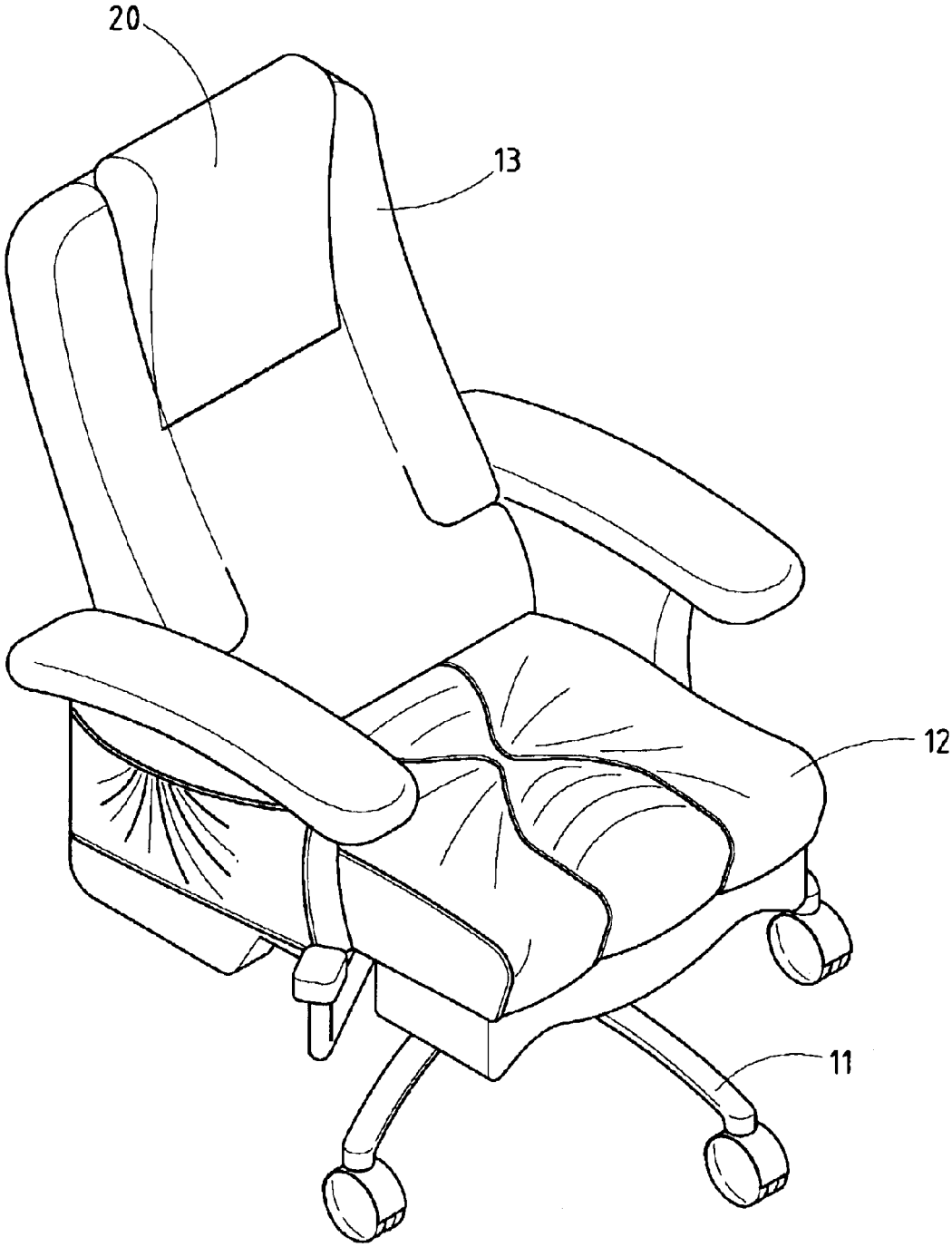
FIG. 1 shows a perspective view of a first preferred embodiment of the present invention serving as a headrest.
Figure 2:
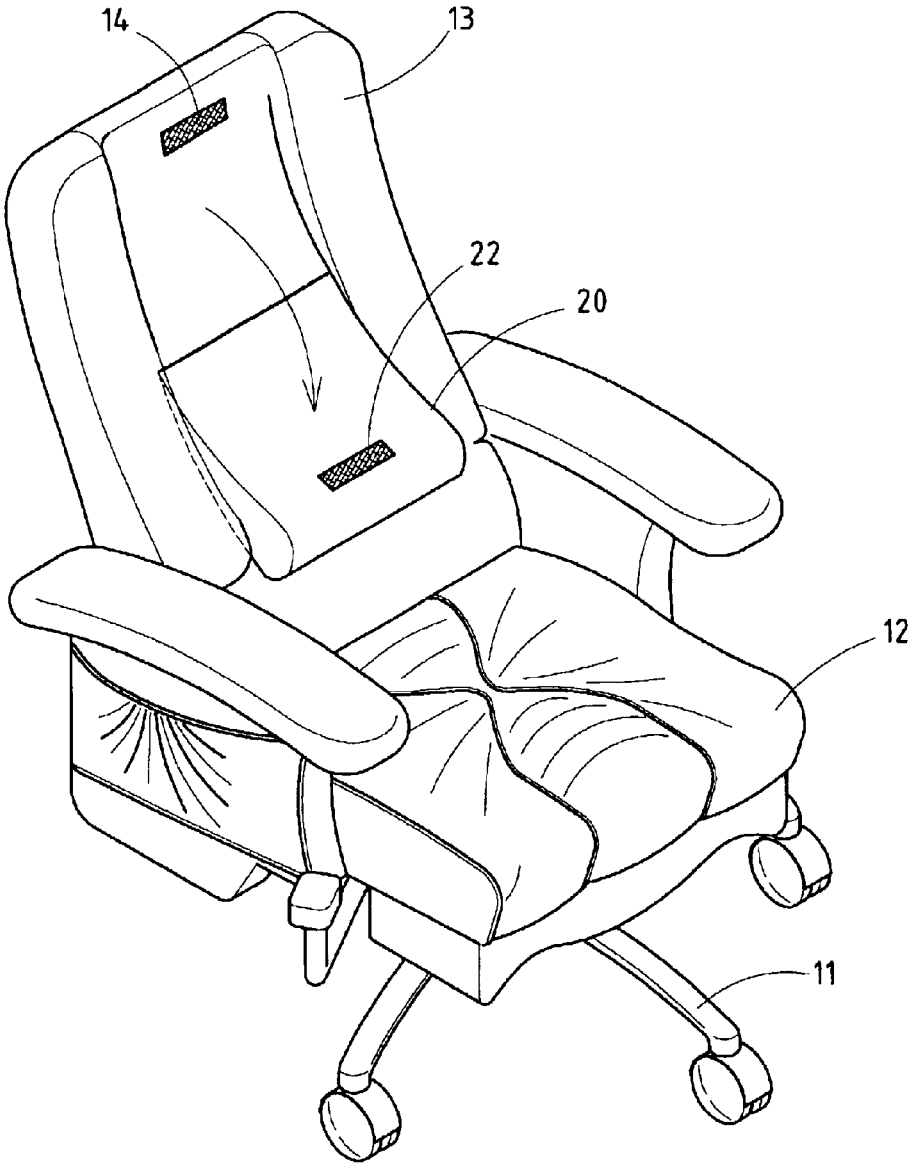
FIG. 2 shows a perspective view of the present invention serving as a waist support.
Figure 3:
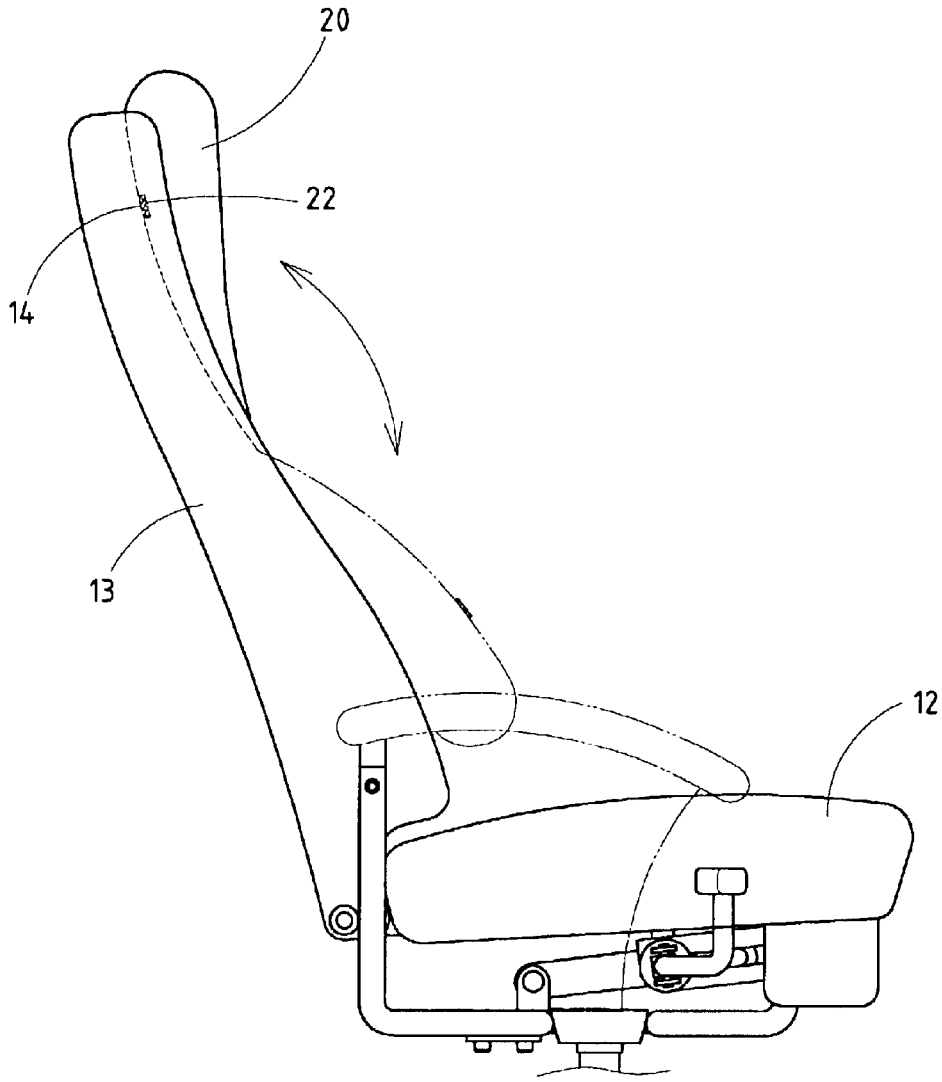
FIG. 3 shows a side schematic view of the present invention in operation.
Figure 4:
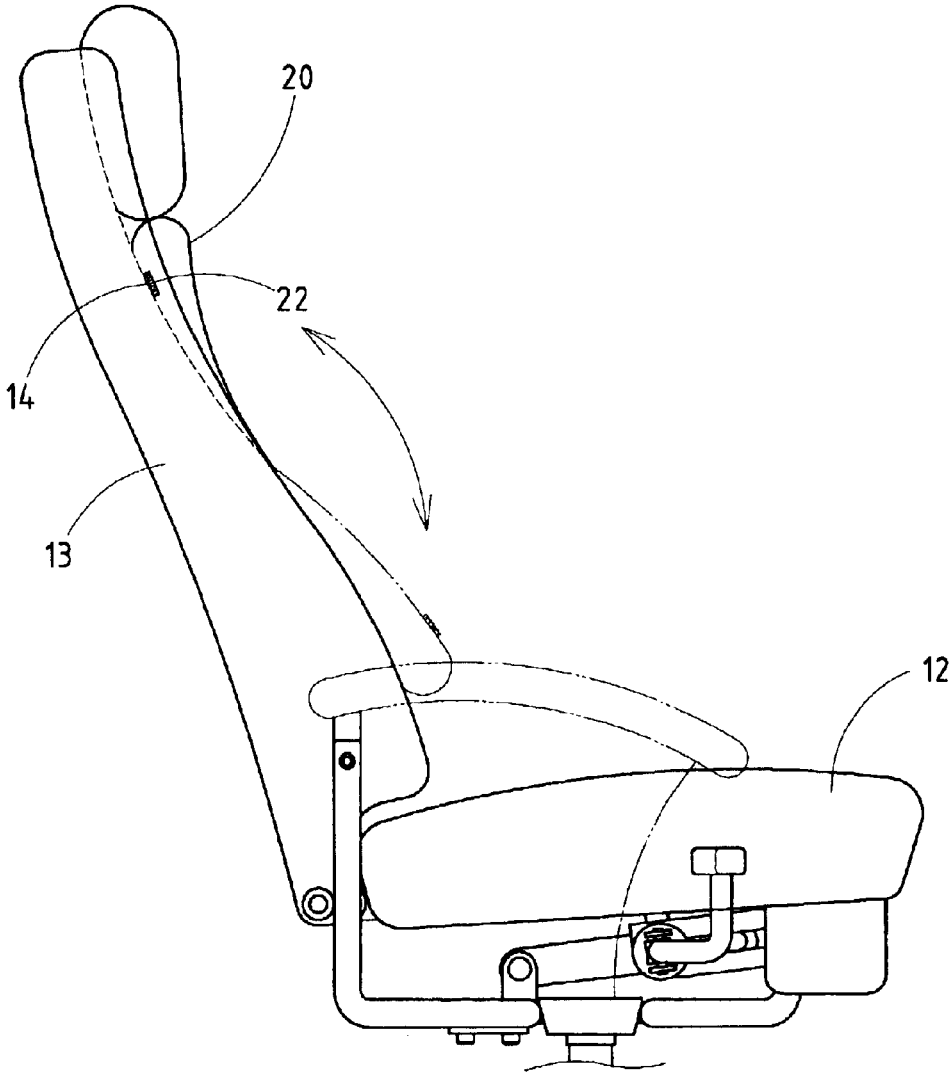
FIG. 4 shows another side schematic views of the present invention in operation.

The backrest 13 of the present invention is provided with a cushion 20 which is an integral part of the backrest 13. The cushion 20 is pliable and movable such that the cushion 20 is used as a headrest, as shown in FIG. 1, a waist support as shown in FIGS. 2 and 3, or a neckrest as shown in FIG. 4.

The backrest 13 is provided in a top edge of the front side with a hook tape 14 of the Velcro device which is also known as magic tape. The cushion 20 is provided in the back side with a loop tape 22 corresponding in location to the hook tape 14. The loop tape 22 is a part of the Velcro device and is a complementary surface of the hook tape 14. The hook tape 14 and the loop tape 22 can be pressed together or pulled apart for easy fastening and unfastening of the cushion 20 with the backrest 13, as illustrated in FIGS. 2–4.

Figure 5:
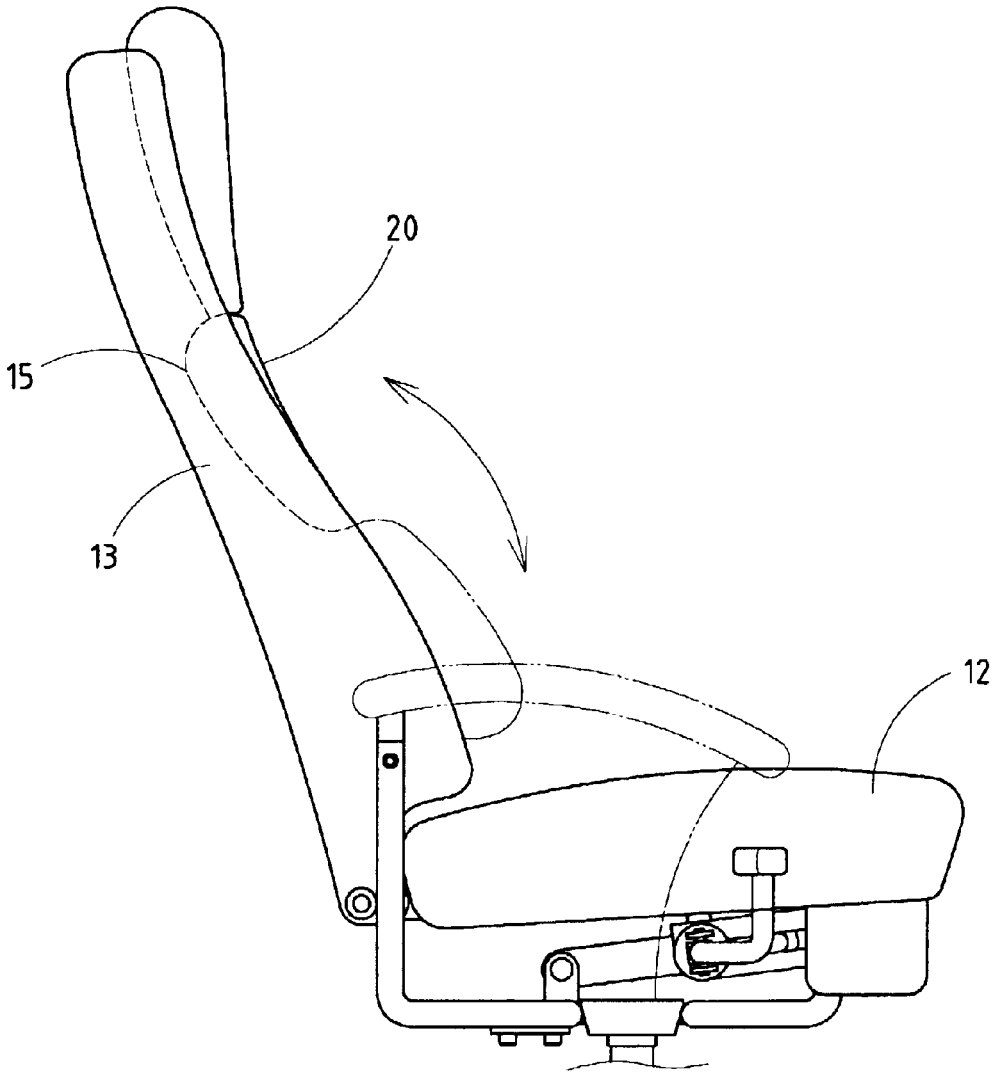
FIG. 5 shows a side schematic view of the present invention with the cushion being located in a recessed portion of the backrest.
Figure 6:
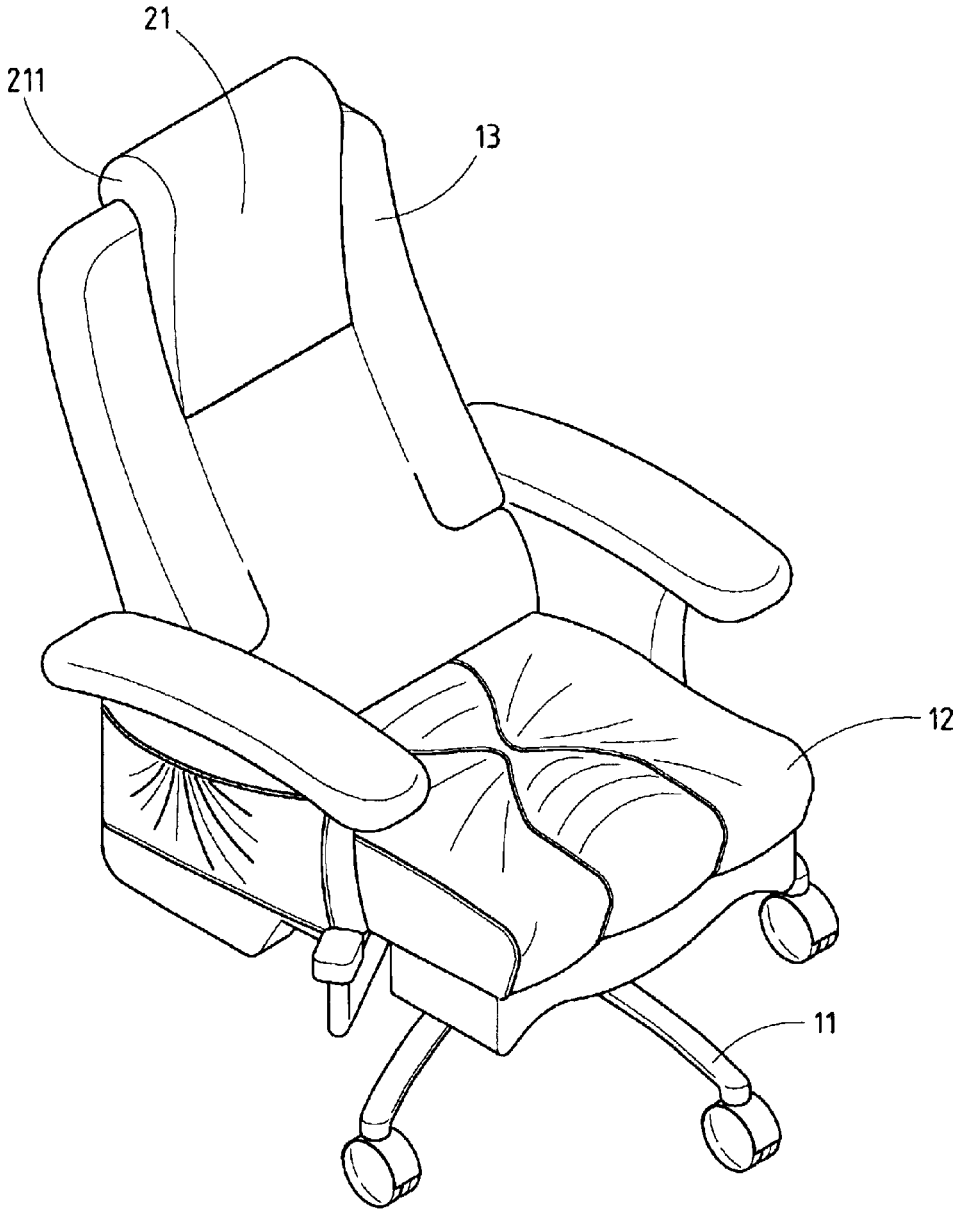
FIG. 6 shows a perspective view of a second preferred embodiment of the present invention.

As shown in FIG. 5, the backrest 13 is provided with a recessed portion 15 to accommodate the cushion 20 such that the cushion 20 is level with the front side of the backrest 13.

Figure 7:
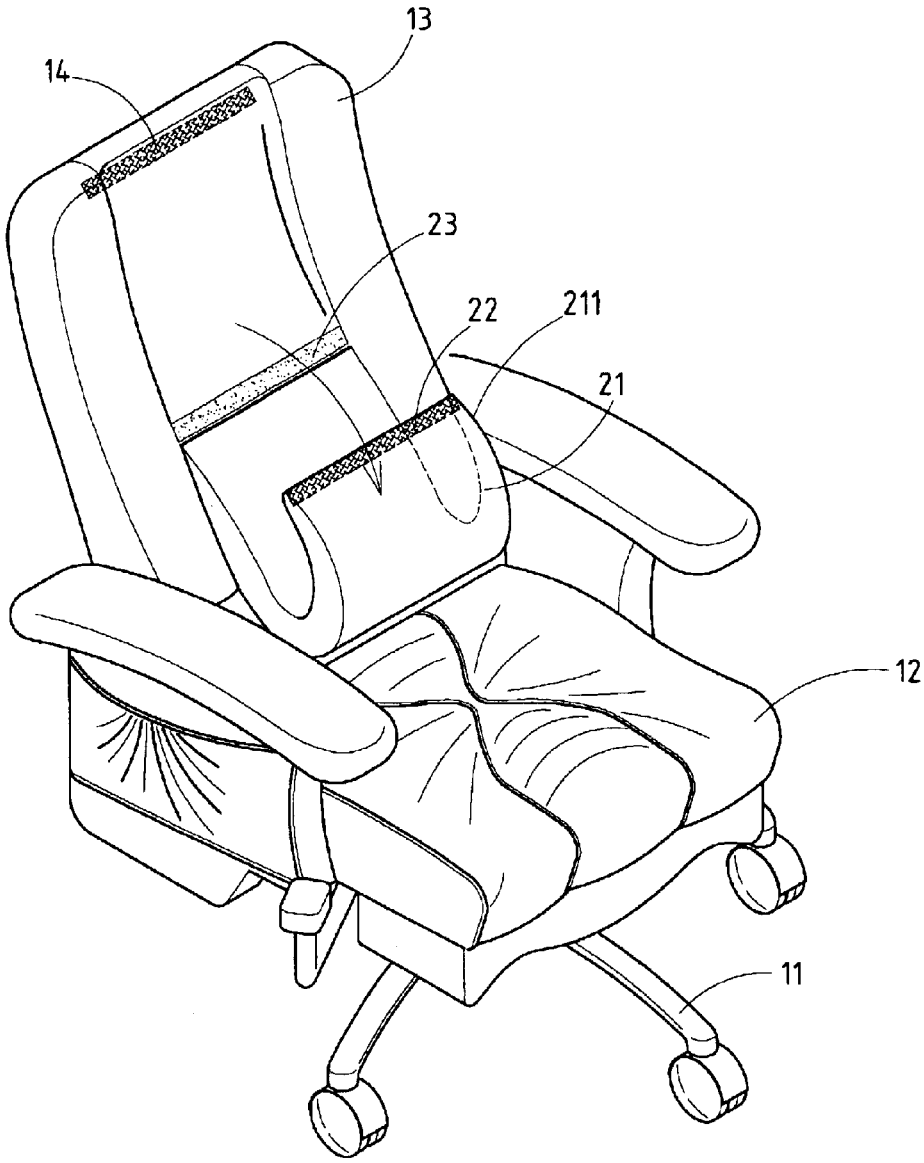
FIG. 7 shows a perspective view of the second preferred embodiment of the present invention serving as a waist support.
Figure 8:
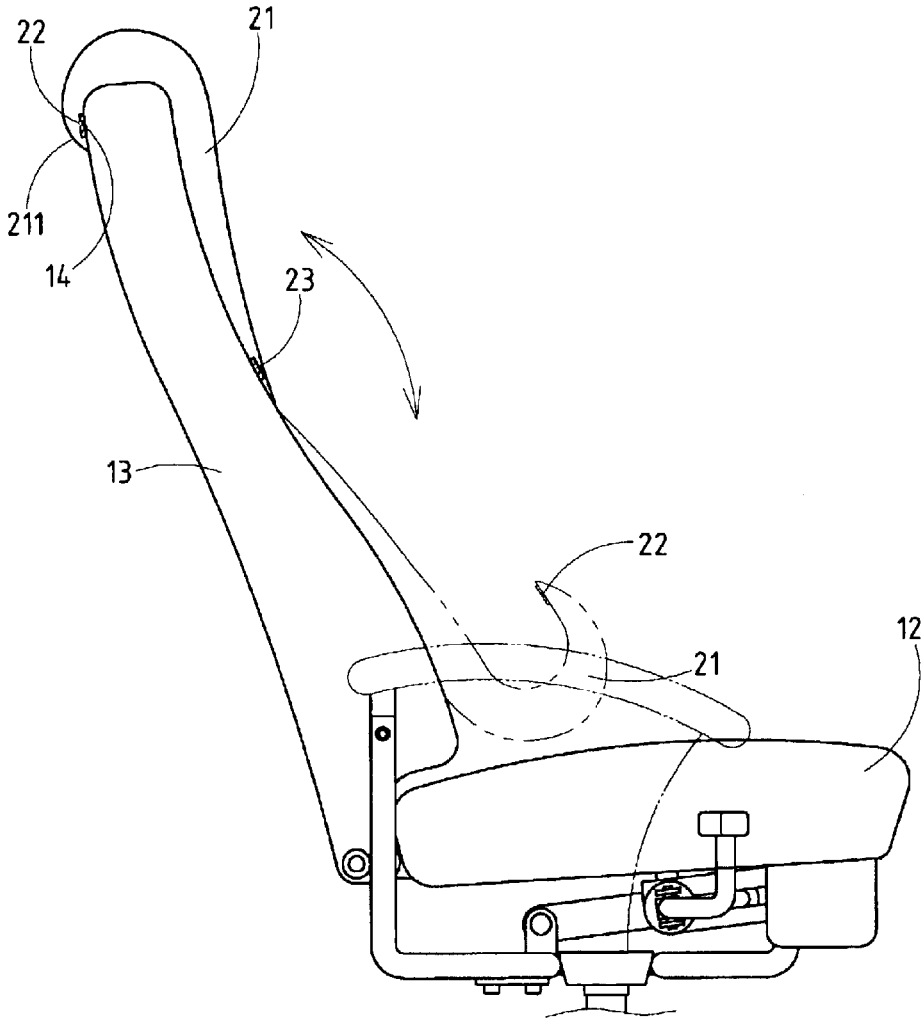
FIG. 8 shows a side schematic view of the second preferred embodiment of the present invention serving as a headrest or waist support.
Figure 9:
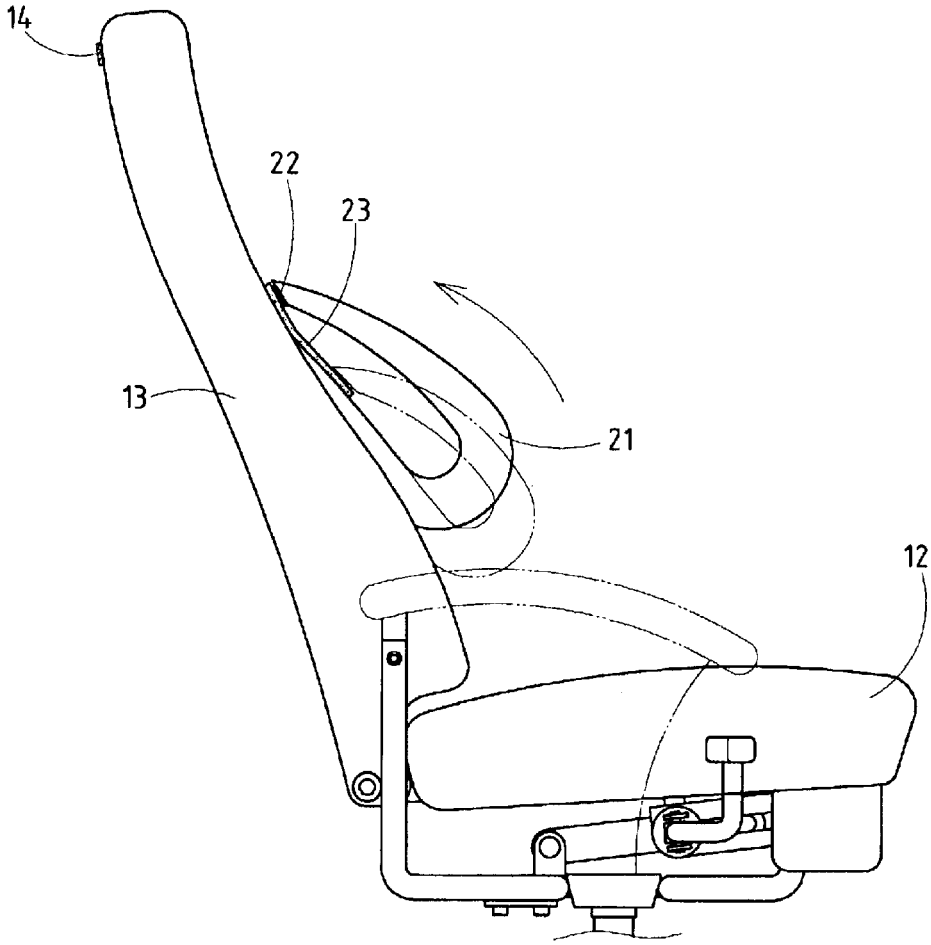
FIG. 9 shows a side schematic view of the second preferred embodiment of the present invention in operation.

As shown in FIGS. 6–9, the backrest 13 of the present invention with a hooked cushion 21 which is pliable and movable. It is provided for use as a headrest or waist support. The hook cushion 21 has a greater elasticity to support the waist of a person seated on the seat 12, as illustrated in FIGS. 7 and 9.

The hooked cushion 21 has a hooked end 211 which is provided with the loop tape 22 of the Velcro device. Meanwhile, the backrest 13 is provided at the top edge of the front side with the hook tape 14 of the Velcro device, and at the midsegment of the front side with another hook tape 23 complementary with the loop tape 22, as shown in FIG. 7. The back side of the top edge of the backrest 13 is provided with another hook tape 14, as shown in FIG. 8. When the hooked cushion 21 is used as a headrest, the hooked cushion 21 is securely located in such a way that the loop tape 22 of the hooked end 211 of the hooked cushion 21 is detachably fastened with the loop tape hook tape 14 of the back side of the top edge of the backrest 13, as shown in FIG. 8. Similarly, the hooked cushion 21 is bent in such a manner that the loop tape 22 of the hooked end 211 is detachably fastened with the hook tape 23 of the midsegment of the backrest 13, as shown in FIG. 9. As a result, the hooked cushion 21 can be adjusted in elasticity.

Figure 10:
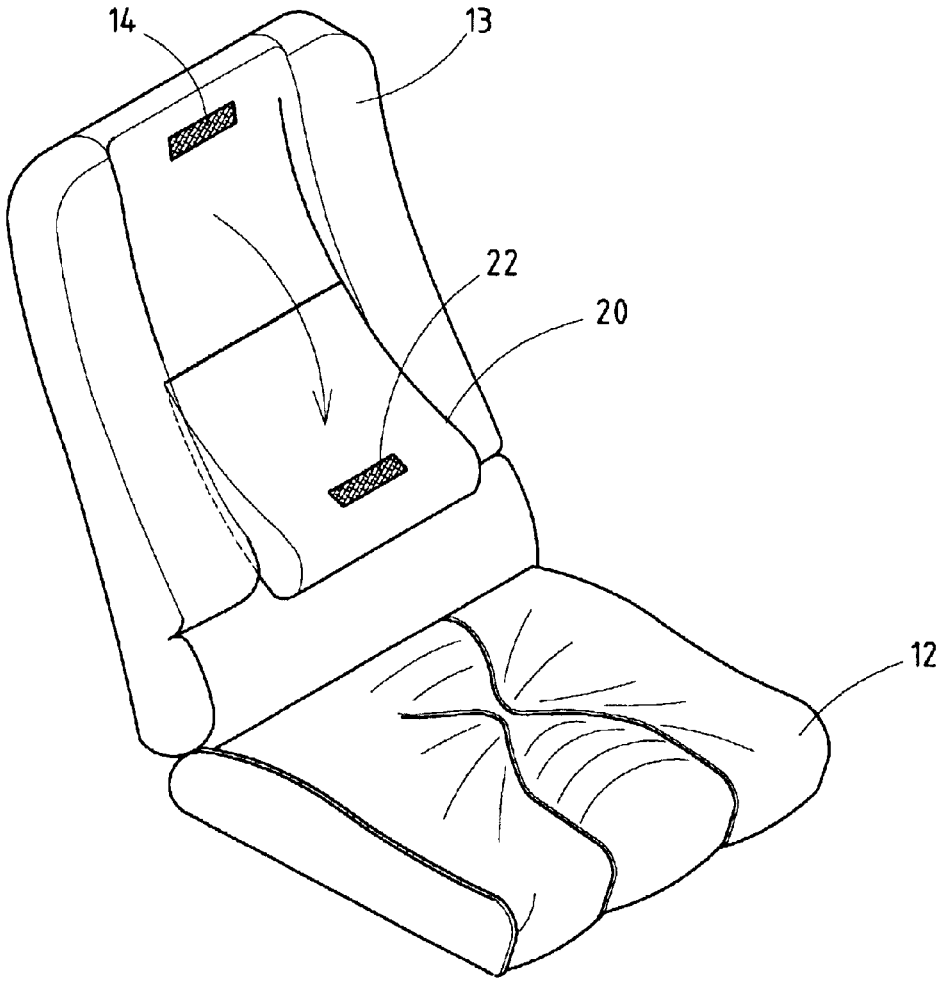
FIG. 10 shows a perspective view of a car seat which is provided with a backrest of the present invention.

As illustrated in FIG. 10, the present invention is applicable to a car seat of the like.

The present invention described above is to be regarded in all respects as being illustrative and nonrestrictive. Accordingly, the present invention may be embodied in other specific forms without deviating from the spirit thereof. The present invention is therefore to be limited only by the scope of the following claims.

We claim:

1. A chair comprising a backrest having an elastic cushion pivotably movable therewith along a midsegment such that said cushion can be used as a headrest, a neckrest, or a waist support, said cushion having a hooked end, said hooked end being removably caught by a top edge of said backrest, said backrest having a first fastening means at a top edge of a front side thereof, said backrest having a second fastening means at the midsegment of the front side thereof, said hooked end of said cushion having a third fastening means detachably engageable either with said first fastening means and said second fastening means.

2. The chair as defined in claim 1, said first fastening means of said backrest and said cushion are two complementary surfaces of hook-and-loop material.

3. The chair as defined in claim 1, said backrest having a recessed portion in a front side to accommodate said cushion such that said cushion is level with the front side of said backrest.

4. The chair as defined in claim 1, said third fastening means is a surface of hook-and loop material, said first fastening means or said second fastening means is a complementary surface of hook-and-loop material so as to be engageable with said third fastening means.

* * * * *